United States Patent [19]

Yamazaki et al.

[11] 4,104,862

[45] Aug. 8, 1978

[54] APPARATUS FOR GENERATING AN ALARM SOUND

[75] Inventors: Hiroshi Yamazaki; Minoru Izawa, both of Tokyo, Japan

[73] Assignee: Kabushiki Kaisha Seikosha, Japan

[21] Appl. No.: 791,774

[22] Filed: Apr. 28, 1977

[30] Foreign Application Priority Data

Apr. 30, 1976 [JP] Japan ..... 51-50657

[51] Int. Cl.[2] ..... G04C 21/28; G04B 23/12

[52] U.S. Cl. ..... 58/38 R; 58/19 R; 58/57.5

[58] Field of Search ..... 58/19 R, 21.155, 38 R, 58/57.5, 152 B; 325/396

[56] References Cited

U.S. PATENT DOCUMENTS 4,016,562 4/1977 Gerum ..... 58/38 R 4,060,973 12/1977 Martino ..... 58/16.5

*Primary Examiner*—Edith S. Jackmon

*Attorney, Agent, or Firm*—Robert E. Burns; Emmanuel J. Lobato; Bruce L. Adams

[57] ABSTRACT

In apparatus for generating an alarm sound especially for small watches, all functions of the alarm are controlled by integrated circuitry which detects the state of a common connection point between a manually operable switch and a reference switch which is opened and closed by the timekeeping mechanism. There is thus only one external terminal led out from the integrated circuit for the purpose of connecting to the output side of the reference switch and the manually operable switch. The reduction in the number of terminals permits a corresponding reduction in the number of pins required and a reduction in the size of the circuit. The integrated control circuit includes flip-flops, gate circuits, inverters and a five minute counter.

4 Claims, 5 Drawing Figures

APPARATUS FOR GENERATING AN ALARM SOUND

BACKGROUND OF THE INVENTION

The present invention relates to apparatus for generating an alarm sound and, more particularly, to apparatus for generating an alarm sound in which the generation of the alarm sound is controlled by electronic means.

Conventionally, many types of electronic alarm clocks have a crystal generator the output of which is divided to actuate the clock and provide a time representation and a suitable one of the divided outputs is further used for generating an alarm sound. These electronic clocks have circuits most of which are integrated. In these integrated circuits, interference by external noises is increases as the number of terminals is increased so as to cause failure or damage of the semiconductor device.

This problem is serious especially in a case where the clock is provided with various modes of alarm functions such as interruption of the alarm or the like, because the number of input terminals of the integrated circuit is increased as the number of switches provided corresponding to each of the aforementioned functions is increased.

SUMMARY OF THE INVENTION

The present invention aims to overcome the above described drawbacks of the prior art by providing a novel apparatus for generating an alarm sound.

According to a principal feature of the invention, there is provided apparatus for generating an alarm sound comprising a reference switch adapted to be opened and closed by a time mechanism, a manually operable switch adapted to be opened and closed manually, first means adapted to cause different outputs at an output terminal in accordance with the modes of operation of the reference switch and the manually operable switch, a pulse generating circuit for generating clock pulses for a plurality of systems, second means for storing operating states of such switches in accordance with the output from the output terminal and the clock pulse of any one of such systems and for producing an output in accordance with the operating states of the switches, and controlling means adapted to control an alarm sound generating circuit upon receipt of at least the output from the second means. Thus, the state or operational status of the reference switch and the manually operable switch are outputed through one output terminal by means of which the states of the switches are detected. The control of the alarm function is therefore performed with a lesser number of terminals.

It is therefore an object of the invention to provide an apparatus for generating an alarm sound comprising an integrated circuit in which the number of terminals is conveniently reduced due to such an arrangement that the operational status of the reference switch and the manually operable switch is fed to a judging circuit through one output terminal.

It is another object of the invention to provide a small-sized apparatus for generating an alarm sound constituted by electronic circuits.

It is still another object of the invention to provide an apparatus for generating an alarm sound in which a sound generating circuit is controlled in different modes by operational states of the reference switch and the manually operable switch which are outputed through one output terminal.

It is a further object of the invention to provide a compact apparatus for generating an alarm sound in which a circuit for judging the modes of operational status of the reference switch and the manually operable switch is integrated for reducing error.

It is still another object of the invention to provide an apparatus for generating an alarm sound in which the modes of operational status of the reference switch and the manually operable switch is detected using clock pulses provided by a frequency divider adapted to divide the output frequency from a crystal generator thereby to control the sound generating circuit.

BRIEF DESCRIPTION OF THE DRAWINGS

The nature of the present invention, as well as other objects and advantageous features thereof will become more apparent from consideration of the following detailed description and the accompanying drawings in which.

DESCRIPTION OF THE PREFERRED EMBODIMENTS

Hereinafter, preferred embodiments of the invention will be described with reference to the accompanying drawings.

Figure 1:
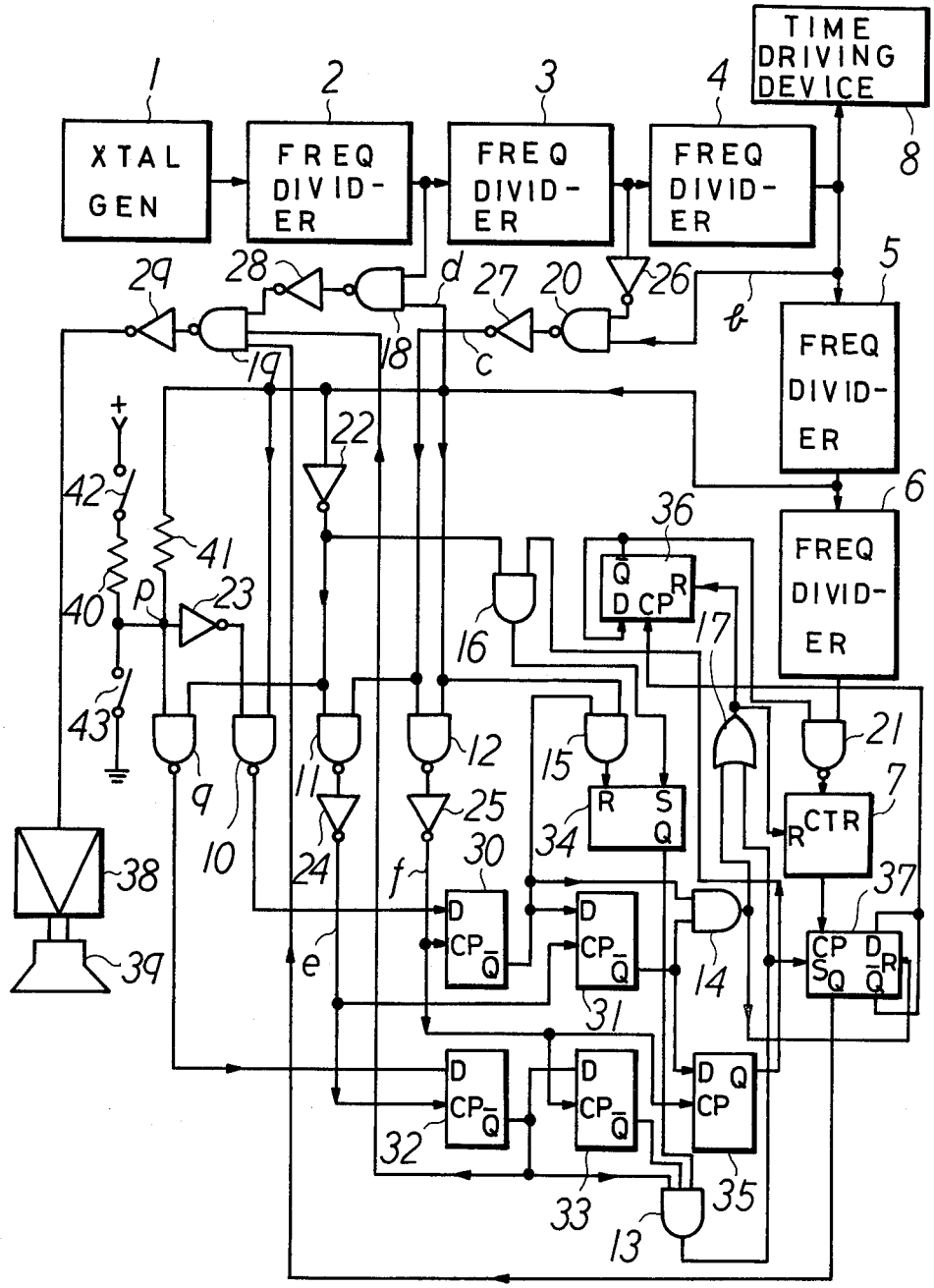
FIG. 1 is an electric circuit diagram showing an embodiment of the present invention.

Referring at first to FIG. 1, frequency dividers 2 to 6 are adapted to divide an output frequency from a crystal oscillator 1. The frequencies of several KHz, 16Hz, 8Hz, 4Hz and 1Hz are provided by the respective frequency dividers. A counter 7 is adapted to produce an output at each 5 minutes and thereupon to clear the content of the counter. The counter 7 determines an interval of intermittent alarm sound.

A time driving device 8 comprises a motor adapted to be driven by the output from the frequency divider 4 and means for transmitting the motion of the motor, through a gear train, to the hands of the clock. Reference numerals 9 to 21, 22 to 29 and 30 to 37 denote gate circuits, inverters and flip-flop circuits, respectively. Reference numerals 38 and 39 denote, respectively, an amplifier and a speaker. A resistance 40 connected in series with a reference switch 42 and a manually operable switch 43 has a value of resistance which is much smaller than that of a resistance 41 in an input line of gate circuit 9. The reference switch 42 is adapted to be actuated by a time mechanism, at a previously set time. Such arrangement is common to most conventional alarm timepieces of this kind, and therefore is not described in detail here.

Figure 2A:
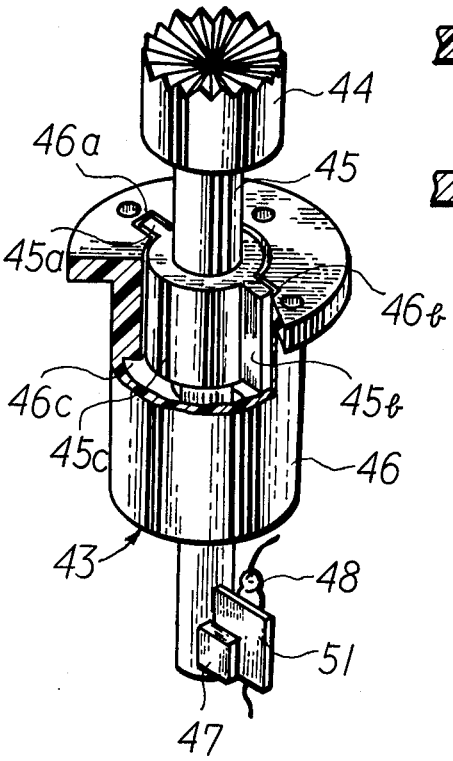
FIG. 2A is an enlarged fragmentary sectional perspective view showing a practical mechanism of a switch of FIG. 1.
Figure 2B:
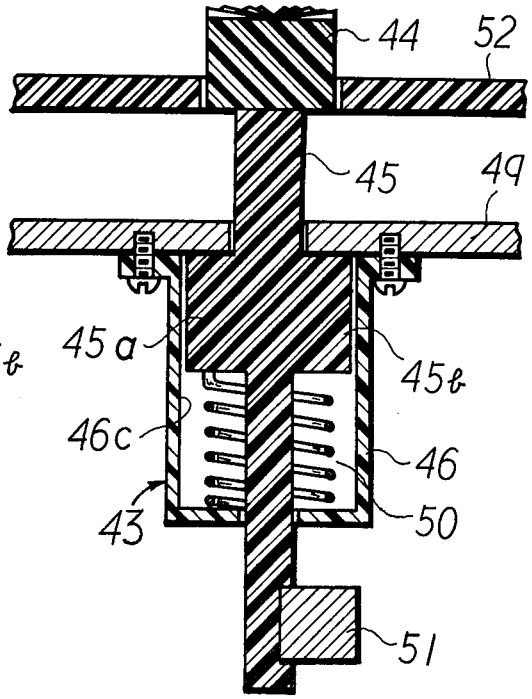
FIG. 2B is a partial longitudinal sectional view of the switch of FIG. 2A attached to an associated member.

The manually operable switch 43 is for setting the alarm, and has a construction as shown in detail in FIGS. 2A and 2B. A shaft 45 has a push button 44 formed at one end and is provided at its mid-portion with a cylindrical portion **45*c* of a larger diameter on which are formed radial projections 45*a* and 45*b*. The shaft 45 is in a sleeve 46 which has different thicknesses in its upper and lower halves, so as to be provided with a step 46***c* at which the upper and the lower halves join each other. Elongated C-shaped grooves 46*a* and 46*b* formed in the upper thick half of the sleeve 46 are adapted to receive the projections 45*a* and 45*b* of the shaft 45, respectively, for free movement up and down as viewed in the drawings. A magnet 47 and a lead switch 48 are fixed to a stationary member (not shown), while the sleeve 46 is fixed to a stationary plate 49 by means of screws. A spring 50 has one end bearing on a bottom part of the sleeve 46 and another end bearing on the cylindrical portion 45*c*, so as normally to bias the shaft 45 upwardly, so as to cause the lead switch 48 of FIG. 2A to be shielded by a shield plate 51 affixed to the shaft 45. The frame of the timepiece is designated by reference numeral 52.

In operation, supposing here that the reference switch 42 and the manually operable switch 43 are both opened, the manually operable switch 43 assumes a position in which, as shown in FIG. 2A, the shielding plate 51 is effective to shield the lead switch 48 from the magnetic field of the magnet 47 so as to open the lead switch 48.

For an easier understanding of the manner of operation, flip-flop circuits 34, 36 and 37 are assumed here to be in reset states. The 4Hz pulse from the frequency divider 5 is on one hand supplied to the gate circuit 9 through the resistance 41, and, on the other hand, is supplied to the gate circuit 10 through the inverter 23. The 4Hz pulse inverted by the inverter 22 is applied to the gate circuit 9, while the gate circuit 10 is supplied directly with the 4Hz pulse, so that the outputs of the gate circuits 9 and 10 are maintained at logic value of "1", respectively.

(Hereinafter, the logic value "1" will be referred to simply as "1".) Accordingly, the inputs D of the flip-flop circuits 30 and 32 are kept at "1", while clock inputs CP of the flip-flop circuits 30 and 32 receive the pulses as explained below. A 16Hz pulse as shown in wave form A of FIG. 3 is delivered to the gate circuit 20, after being inverted by the inverter 26, from the frequency divider 3, while an 8Hz pulse, as shown in wave form B of FIG. 3, from the terminal *b* of the frequency divider 4 is supplied also to the gate circuit 20.

Figure 3:
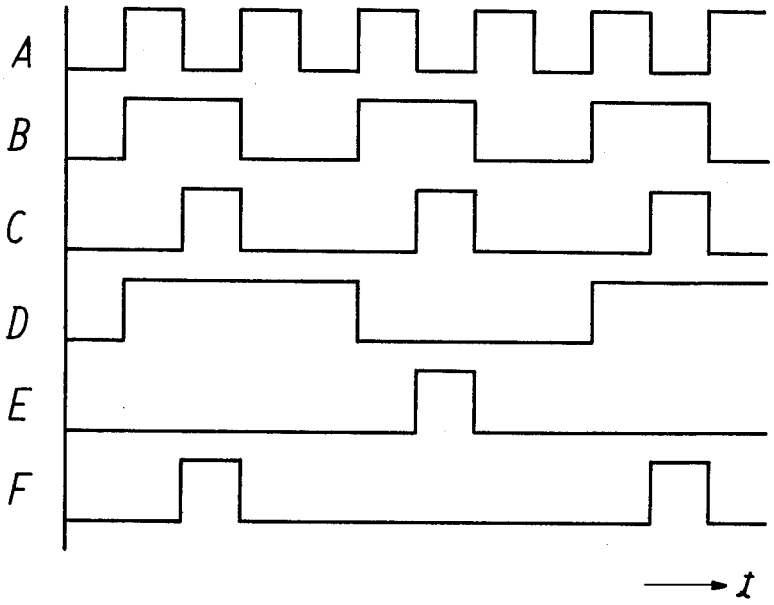
FIG. 3 is a timing chart showing wave forms at essential parts of the circuit diagram of FIG. 1.

Therefore, a pulse as shown in wave form C of FIG. 3, is obtained at the output of the inverter 27, and is delivered to the gate circuits 11 and 12. The gate circuits 11 and 12 receive the 4Hz pulse of wave form D of FIG. 3 after being inverted by the inverter 22 and the 4Hz pulse before inverted, respectively. Consequently, a pulse as shown in wave form E of FIG. 3 is obtained at the output terminal *e* of the inverter 24, and is supplied to the clock inputs CP of the flip-flop circuits 31 and 32, while a pulse as shown in wave form F of FIG. 3 is obtained at the output terminal *f* of the inverter 25, and is delivered to the clock outputs CP of the flip-flop circuits 30, 33 and 35.

As stated before, since the outputs of the gate circuits 9 and 10 are kept at "1", respectively, the outputs $\overline{Q}$ are turned to a logic value of "0" (hereinafter referred to simply as "0"), when pulses are supplied to the clock inputs of the flip-flop circuits 30 and 32. The gate circuit 19 is closed by the output $\overline{Q}$ of the flip-flop circuit 32, so that the pulse through the gate circuit 18 is checked. Accordingly no sound is produced in the speaker 39. On the other hand, the output $\overline{Q}$ of the flip-flop circuit 32 keeps the output of the gate circuit 13 at "0".

Since the inputs D of the flip-flop circuits 31 and 33 are preserved at "0", because the outputs $\overline{Q}$ of the flip-flop circuits 30 and 32 are "0", the outputs $\overline{Q}$ of the flip-flop circuits 31 and 33 are kept at "1". Therefore, the input D of the flip-flop circuit 35 is turned to "1" so that the output Q is kept at "1" when a pulse is supplied to its clock input CP. Then, the gate circuit 16 is opened by the output Q of the flip-flop circuit 35, so that the pulse through the inverter 22 is allowed to pass therethrough to set the flip-flop circuit 34, so as to invert its output to "1".

In this state, as the reference switch 42 is closed by a time mechanism at the previously set time, the connection terminal P is set at "1", because the resistance 40 is much smaller than the resistance 41. Consequently, the input of the gate circuit 9 is kept at "1" to produce an output pulse of wave form D of FIG. 3 from the inverter 22.

Meanwhile, since the input of the gate circuit 10 is set at "0", the output thereof is turned to "1". When the pulse of wave form E of FIG. 3 is supplied by the inverter 24, during the period in which the pulse from the gate circuit 9 keeps the input D of the flip-flop circuit 32 at "0", the output $\overline{Q}$ of the flip-flop circuit 32 is inverted to "1", to keep one input of the gate circuits 19 at "1". Consequently, as the outputs $\overline{Q}$ and Q of respective flip-flop circuits 33 and 34 are kept at "1", the output of the gate circuit 13 is turned to "1". The output $\overline{Q}$ of the flip-flop circuit 33 is then inverted to "0", as the pulse of wave form F of FIG. 3 is generated at the output of the inverter 25, resulting in a pulse at the output of the gate circuit 13. This resultant pulse on one hand sets the flip-flop circuit 37, and, on the other hand, resets the flip-flop circuit 36 and the counter 7, through the gate circuit 17. The gate circuit 19 is closed by the output Q of the flip-flop circuit 37, so that the gate circuit 18 delivers a pulse of several KHz for a period of ¼ second to the inverter 28 and the gate circuit 19, and further to the amplifier 38 through the inverter 29, thereby to produce an alarm sound in the speaker 39.

Meanwhile, the above mentioned reset of the flip-flop circuit 36 causes its output $\overline{Q}$ to open the gate circuit 21, so as to allow a 1Hz pulse from the frequency divider 6 to pass therethrough to the counter 7. When the counter 7 counts a period of 5 minutes, the output is supplied to the clock input CP of the flip-flop circuit 37, to invert the levels of its outputs Q and $\overline{Q}$. Consequently, the gate circuit 19 is closed to stop the alarm sound and the output $\overline{Q}$ of the flip-flop circuit 36 is turned to "0", so as to check the pulse supply to the counter 7 by closing the gate circuit 21.

As stated above, the alarm sound is generated when the reference switch 42 is closed, and is stopped 5 minutes thereafter. The duration or continuation of the alarm sound is not limited to 5 minutes, as any desired period can be obtained by optionally adjusting the counter 7.

An operation for manually stopping the alarm sound will now be explained. In the condition that the reference switch 42 is closed and an alarm sound is generated, as the manually operable switch is closed, i.e. as the pushbutton 44 of FIG. 2A is depressed, the shielding plate 51 is shifted downwardly to open the shield to allow the lead switch 48 to close. Consequently, the connecting terminal P is kept at "0" to keep the output of the gate circuit 9 at "1" so that the gate circuit 10 generates an inverted pulse of wave form D of FIG. 3. Consequently, the output $\overline{Q}$ of the flip-flop circuit 32 is turned to "0", as the pulse of wave form E of FIG. 3 is generated at the output of the inverter 24, so that the gate circuit 19 is closed to stop the alarm sound. On the other hand, the pulse from the gate circuit 10 causes the input D of the flip-flop circuit 30 to go to "0". At this state, as the pulse of wave form F of FIG. 3 is supplied from the inverter 25, the output $\overline{Q}$ of the flip-flop circuit 30 is turned to "1".

Since the output $\overline{Q}$ of the flip-flop circuit 31 is kept at "1" until the pulse of wave form E of FIG. 3 is supplied from the inverter 24, the output of the gate circuit 14 is kept at "1" during that period. Consequently, the flip-flop circuit 37 is reset to invert its output to "0", thereby to keep the input of the gate circuit 19 at "0". The output "1" from the gate circuit 14 resets the counter 7 and the flip-flop circuit 36 through the gate circuit 17. The counter 7 therefore commences counting time at this instant.

Meanwhile, by the above mentioned inverse of the output $\overline{Q}$ of the flip-flop circuit 30, the gate circuit 15 is opened to allow the pulse of wave form D of FIG. 3 to pass therethrough. Accordingly, the flip-flop circuit 34 is reset to invert its output to "0", to close the gate circuit 13. In this state, as the manually operable switch 43 is opened again, the connection terminal P is again turned to "1" so that the outputs of the flip-flop circuits 30 and 32 are turned to "0" and "1", respectively, thereby to turn one input of the gate circuit 13 to "1". However, since in this state the gate circuit 13 is closed by the output Q from the flip-flop circuit 34, this output keeps the flip-flop circuit 37 in the reset state, so that the gate circuit 19 is still kept closed.

As the counter 7 counts 5 minutes, its output is supplied to the clock input CP of the flip-flop circuit 37, so that the levels of the outputs Q and $\overline{Q}$ are inverted to open the gate circuit 19 to allow an alarm sound to generate. At this time, the flip-flop circuit 36 is still in the reset condition to keep the gate circuit 21 opened, so that the pulse supply to the counter 7 goes on. When the next 5 minutes has been counted, the corresponding output is supplied to the clock input CP of the flip-flop circuit 37 which in turn provides an output to close the gate circuit 19, thereby to stop the alarm sound. Meanwhile, the output $\overline{Q}$ from the flip-flop circuit 37 is supplied to the clock input CP of the flip-flop circuit 36 whose output $\overline{Q}$ then acts to close the gate circuit 21.

It often becomes necessary optionally to activate the alarm skipping over the suspension period of 5 minutes, as in the case of demonstration for clients at the watch store. For this purpose, the alarm can be activated at once by operating the reference switch 42 in the following manner. As the reference switch 42 is opened, after once set for the suspension of the alarm, the flip-flop circuits 30 to 35 are returned to their starting conditions. A subsequent closing of the reference switch 42 causes, in the manner described before, the output $\overline{Q}$ from the flip-flop circuit 32 to turn to "1", and to cause a pulse from the gate circuit 13. Consequently, the flip-flop circuit 37 is set to open the gate circuit 19 to allow the alarm sound. As has been described, the alarm sound is stopped temporarily and becomes available 5 minutes afterward, by closing and then opening again the manually operable switch 43. In addition, the alarm sound can be obtained optionally at any time, by opening and closing the reference switch 42, subsequent to the setting for suspension.

The duration of suspension and generation of the alarm sound can be optionally set by the counter 7, so that only one counter is necessitated, contributing to simplifying the whole structure.

For completely turning off the alarm, the manually operable switch 43 is kept in closed state. More specifically, referring to FIG. 2A, the push button 44 is depressed to bring the upper ends of the projections **45*a* and 45*b* of the shaft 45 slightly below the level of the recesses 46*a* and 46*b* of the sleeve 46, and is then rotated. Consequently, the upper edges of the projections 45*a* and 45*b* come to abut the step 46*c* of the sleeve 46, so that the shaft 45 is maintained at such lowered position, when the depressing force is released, to keep the shielding plate 51 in the lowered position. The lead switch 48 is therefore kept closed, to keep the manually operable switch 43 of FIG. 1 closed, which preserves the "0" state of the output $\overline{Q}$ of the flip-flop circuit 32 to maintain the closed state of the gate circuit 19**. The alarm sound is therefore turned off.

Figure 4:
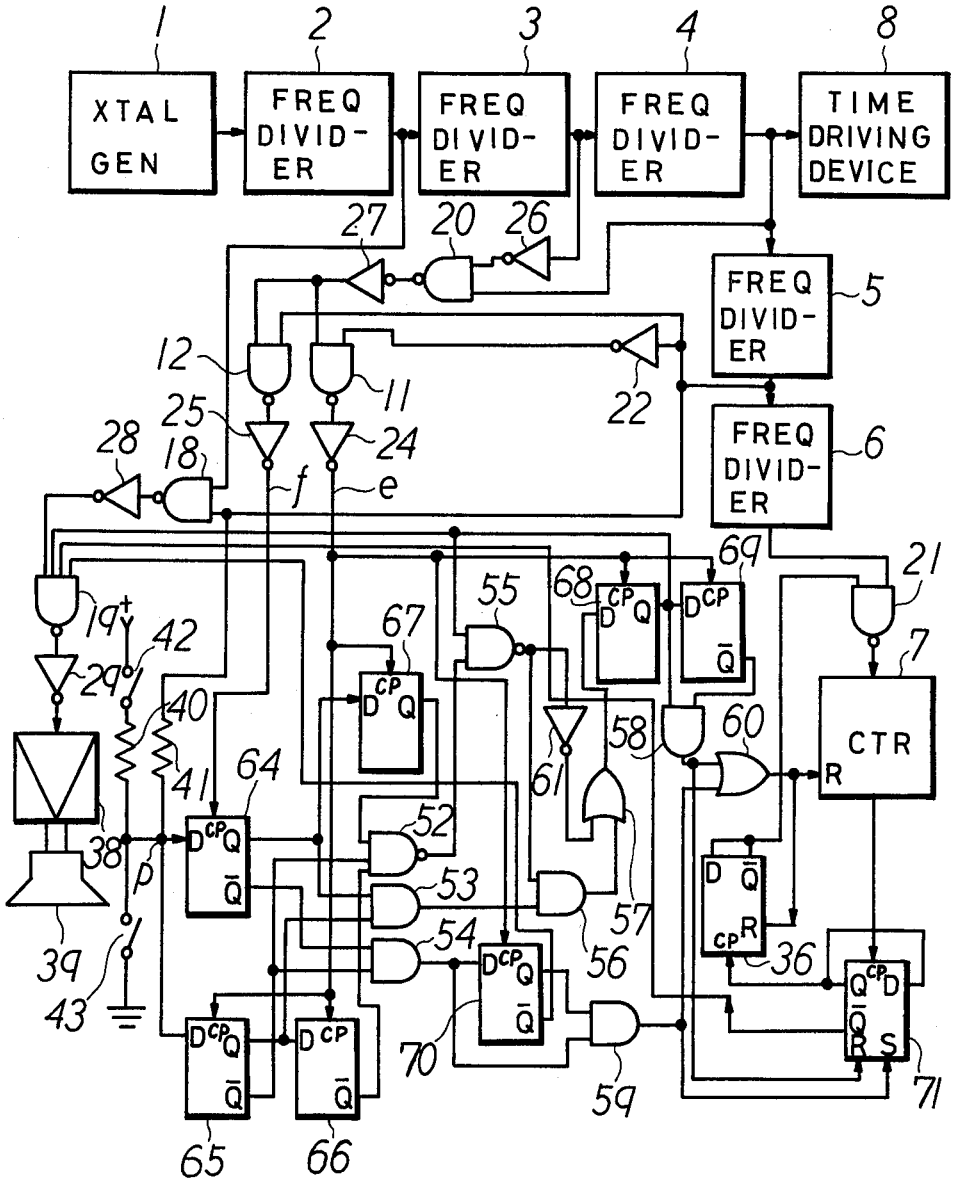
FIG. 4 is an electric circuit diagram of another embodiment of the invention.

Referring now to FIG. 4 showing another embodiment of the invention, reference numerals 52 to 60, 61 and 64 to 71 denote, respectively, gate circuits, an inverter and flip-flop circuits. The same numerals as FIG. 1 denote the same parts as shown in FIG. 1.

In operation, when the reference switch 42 and the manually operable switch 43 are both opened, the connection terminal P produces a 4Hz pulse as shown in wave form D of FIG. 3, which is delivered to the inputs D of the flip-flop circuits 64 and 65. Meanwhile, these flip-flop circuits are supplied, through respective terminals *f* and *e*, with clock pulses as shown in wave forms F and E of FIG. 3. As the clock pulses are applied to the flip-flop circuits 64 and 65 when the D inputs thereof are "1" and "0", respectively, the respectively outputs Q of those flip-flop circuits turn to "1" and "0". As a clock pulse is supplied through the terminal *e* to an input of the flip-flop circuit 64 under a condition that the output Q of the flip-flop circuit 64 is "1", the output Q of the flip-flop circuit 67 turns to "1", so as to keep one input of the gate circuit 52 at "1".

On the other hand, as the clock pulse is supplied through the terminal *e* with the output Q of the flip-flop circuit 65 is kept at "0", the output $\overline{Q}$ of the flip-flop circuit 66 turns to "1" to keep one input of the gate circuit 52 at "1". At this moment, since the output $\overline{Q}$ of the flip-flop circuit 65 is kept at "1", the inputs of the gate circuit 52 are all kept at "1", so that the output thereof is kept at "0". Therefore, the outputs of the gate circuit 55 and the inverter 61 are turned to "1" and "0", respectively. Meanwhile, the output Q of the flip-flop circuit 65 turns the outputs of the gate circuits 53 and 56, respectively, to "0". Therefore, the inputs of the gate circuit 57 are both "0", so that an output of "0" is produced. Consequently, the output Q of the flip-flop circuit 68 is turned to "0" by a clock pulse produced at the terminal *e*.

Therefore, one input of the gate circuit 19 is kept at "0" so that the pulse having passed through the inverter 28 is not allowed to pass the gate circuit 19, whereby no alarm sound is generated in the speaker 39. Since the output Q of the flip-flop circuit 68 is supplied to the input D of the flip-flop circuit 69, the output $\overline{Q}$ is turned to "1", when a pulse is produced at the terminal *e*, thereby to keep the one input of the gate circuit 58 at "1". Since the output of the gate circuit 65 acts to keep the output of the gate circuit 54 at "0", the outputs Q and $\overline{Q}$ of the flip-flop circuit 70 are kept at "0" and "1", respectively.

Above stated condition or status of the circuit is kept when the reference switch 42 and the manually operable switch 43 are both opened. When the reference switch 42 is closed at the previously set time, the connection terminal P turns to "1". Consequently, when a clock pulse is supplied to the flip-flop circuit 65, the outputs Q and $\overline{Q}$ are turned to "1" and "0", respectively. Meanwhile the outputs Q and $\overline{Q}$ of the flip-flop circuits 64 are kept at "1" and "0", respectively, both inputs of the gate circuit 53 now turn to "1" to invert the output of the gate circuit 53 to "1". As a result, the output of the gate circuit 56 is turned to "1" which, through the gate circuit 57, turns the D input of the flip-flop circuit 68 to "1". A subsequent supply of a clock pulse through the terminal *e* causes the output Q of the flip-flop circuit 68 to turn to "1", so as to turn the one input of each of the respective gate circuits 19 and 55 to "1". Meanwhile the above clock pulse to the flip-flop circuit 68 is supplied also to the flip-flop circuit 66 to turn its output $\overline{Q}$ to "0", causing the output of the gate circuit 52 to turn to "1", so that the output of the gate circuit 55 turns to "0". Therefore, the output of the inverter 61 is turned to "1", so as to make the D input of the flip-flop circuit 68 "1" through the gate circuit 57.

Therefore, the output of the flip-flop circuit 68 is kept "1", thus storing the closing of the reference switch 42. Meanwhile, the level inverting of the output Q of the flip-flop circuit 68 causes the output of the gate circuit 58 to turn to "1", so that the output of the gate circuit 58 is kept at "1" until the next clock pulse is supplied to the flip-flop circuit 69 through the terminal *e*.

Therefore, the flip-flop circuit 71 is reset by the output of the gate circuit 58 to turn the output $\overline{Q}$ to "1", thereby keeping one input of the gate circuit 19 at "1". Meanwhile, since the output $\overline{Q}$ of the flip-flop circuit 70 is kept at "1", the gate circuit 19 is opened to allow the pulse having passed the inverter 28 to go therethrough, thereby to actuate the speaker 39 to produce the alarm sound.

The output of the gate circuit 58 acts to reset the counter 7 and the flip-flop circuit 36 through the gate circuit 60. The output $\overline{Q}$ of the flip-flop circuit 36 opens the gate circuit 21, so as to count the 1Hz pulses by the counter 7.

Then, in the same manner as described above, the output of the counter 7, having counted 5 minutes is supplied to the input of the flip-flop circuit 71 to stop the alarm sound.

The operation initiated by the opening of the manually operable switch 43, after the closing thereof, subsequent to the closing of the reference switch 42 will now be described.

When the manually operable switch 43 is closed, when the reference switch 42 is kept closed to allow the alarm sound, the terminal P is turned to "0". This causes the turning of the outputs Q and $\overline{Q}$ of the flip-flop circuits 65 and 64 to "0" and "1", respectively, by the clock pulses delivered through the terminals *e* and *f*. Consequently, the output of the gate circuit 54 is turned to "1", so that the outputs Q and $\overline{Q}$ of the flip-flop circuit 70 are turned to "1" and "0", respectively, by the clock pulse from the terminal *e*. The inverter output $\overline{Q}$ causes one input of the gate circuit 19 to turn to "0", so that the alarm sound is stopped.

Meanwhile, the inverted output Q acts to invert the output level of the gate circuit 59, thereby to set the flip-flop circuit 71. Therefore, one input of the gate circuit 19 is kept at "0". The output of the gate circuit 59 resets the counter 7 and the flip-flop circuit 36, while the flip-flop circuits 68 and 69 are kept in the aforementioned state by the output of the gate circuit 57.

A subsequent opening of the switch 43 again causes the flip-flop circuits 64 and 67 and the flip-flop circuit 70 to return to the same state as in the aforementioned case in which only the reference switch 42 is closed. However, the statuses of the flip-flop circuits 68 and 69 are not changed. Therefore, the flip-flop circuit 71 keeps the same set state and goes on to output $\overline{Q}$ of "0". The gate circuit 19 is accordingly kept closed not to allow the activation of the alarm. Meanwhile, by the above returning of the flip-flop circuit 70, the output levels of the gate circuits 59 and 60 are inverted, so as to dismiss the reset of the counter 7 and the flip-flop circuit 36, so as to allow the counter 7 to commence counting time.

The alarm sound is kept stopped, until the counter 7 counts the period of 5 minutes, similarly as in the aforementioned case. When the 5 minutes have been counted by the counter 7, the output of the later inverts the output of the flip-flop circuit 71 to allow the gate circuit 19 to open, thereby to generate the alarm sound.

For completely stopping or dismissing the alarm, the manually operable switch 43 is kept closed, as is the case in the foregoing embodiment. It will be seen that the output $\overline{Q}$ of the flip-flop circuit 70 is kept at "0", thereby to keep the gate circuit 19 closed to stop the alarm completely.

As has been described, the statuses of the switches 42 and 43 are detected by means of the outputs of the flip-flop circuits 64 and 65 which are applied directly with the output obtained at the connection terminal P, so as to control the operation of the alarm.

An equivalent effect is obtained by directly connecting the connection terminal P to the flip-flop circuit 30, with the gate circuits 9 and 10 being removed, when the inverter 23 is directly connected to the flip-flop circuit 32, with the clock pulses of the terminals *e* and *f* being delivered to the flip-flop circuits 30 and 32.

As has been described, according to the invention, since the control of the alarm is performed by the status of the signal at the connection terminal P, in case the alarm circuit is integrated, there is only one external terminal led out from the integrated circuit for the purpose of connecting to an output side of the reference switch and the manually operable switch.

In addition, since the reference switch used in conventional alarm timepiece is usually connected to the electric power source, these conventional timepieces can be modified in accordance with the invention using the conventional reference switch without substantial change.

Thus, to sum up, due to provision of a common connection terminal at output sides of two switches corresponding respectively to two different voltage levels and controlling the generation of the alarm sound by the detection of the voltage level at the common connection terminal, the switching status of the switches can be detected using a lesser number of switches. This provides a substantial convenience for integrating the circuit, because the number of pins can be reduced to minimize the size of the circuit.

Therefore, the invention can be most effectively applied to compact or small-sized timepieces, ensuring a variety of alarm operaton modes with a lesser number of terminals.

In addition, the integrated circuit in accordance with the invention having a lesser number of input terminals is better protected against electrostatic breakage, as compared with the conventional integrated circuit having a large number of terminals.

What is claimed is:

1. In an electric timepiece comprising a time mechanism, apparatus for generating alarm sound comprising:
   - a reference switch adapted to be opened and closed by said time mechanism;
   - a manually operable switch;
   - first means adapted to produce different outputs at an output terminal in accordance with the operational statuses of said switches;
   - a pulse generating circuit adapted to produce a plurality of clock pulse trains;
   - second means adapted to store the operational statuses of said switches on the basis of an output from said output terminal and any one of said clock pulse trains and to produce different outputs in accordance with the statuses of the switches;
   - an alarm sound generating circuit;
   - and controlling means adapted to control said alarm sound generating circuit upon receipt of an output signal from at least said second means.

2. An apparatus for generating alarm sound as claimed in claim 1, wherein said first means, said reference switch and said manually operable switch are connected in series, one of terminals of said reference switch being kept at a predetermined potential, and one terminal of said manually operable switch being kept at a different potential, said output terminal being the juncture of said reference and manually operable switches.

3. An apparatus for generating alarm sound as claimed in claim 1, wherein said pulse generating circuit comprises a crystal oscillator and a frequency divider adapted to divide the frequency output from said crystal oscillator.

4. An apparatus for generating alarm sound as claimed in claim 1, wherein said controlling means comprise a counter adapted to count a predetermined time upon receipt of a predetermined clock pulse train from said pulse generating circuit and to be cleared by said second means, third means adapted to be controlled by outputs from said second means and said counter and to produce an output in accordance with the control by said outputs from said second means and said counter, fourth means adapted to control said alarm generating circuit by a cooperation of the outputs from said second and third means with each other, a fifth means adapted to be controlled by outputs from said second and said fourth means adapted to check the pulse supply to said counter upon receipt of said output from said fifth means.

* * * * *